US006761176B2

(12) United States Patent
Yoo

(10) Patent No.: US 6,761,176 B2
(45) **Date of Patent: *Jul. 13, 2004**

(54) TOBACCO SUBSTITUTE COMPOSITION

(76) Inventor: Gi Yong Yoo, 103-1703, Ssangbangwool APT.,130-3,Beon 3-dong, Kangbuk-ku, Seoul (KR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/295,850

(22) Filed: Apr. 21, 1999

(65) Prior Publication Data

US 2003/0200976 A1 Oct. 30, 2003

(51) Int. Cl.[7] ..... A24B 15/00

(52) U.S. Cl. ..... 131/359; 131/270; 131/274; 131/275; 131/276; 131/347; 131/352; 131/353

(58) Field of Search ..... 131/359, 270, 131/274, 275, 276, 347, 352, 353

(56) References Cited

U.S. PATENT DOCUMENTS 2,930,719 A * 3/1960 Finberg ..... 131/17
4,506,684 A 3/1985 Keritsis ..... 131/369
4,600,025 A 7/1986 Grigg et al. ..... 131/335
4,620,554 A * 11/1986 Horimoto ..... 131/270
4,719,929 A 1/1988 Breckwoldt ..... 131/359
4,813,438 A 3/1989 Fleming ..... 131/359
5,525,340 A * 6/1996 Fukumaga ..... 424/195.1

OTHER PUBLICATIONS

Shin, Y, Preparation of Cigarettes from Eucommia Leaves, Derwent 1992–030793, Abstract, Oct. 1990.*

Webster, Mirriam, Webster's 3rd New International Dictionary, pp. 970, 783, Jan. 1961.*

Shin, H, Tobacco Substitute Production, Derwent 1987–289596, Abstract, Apr. 1987.*

MacLean, M, Tobacco Substitutes, Derwent 1985–230156, Abstract Aug. 1985.*

* cited by examiner

*Primary Examiner*—Steven P. Griffin
*Assistant Examiner*—Mark Halpern
(74) *Attorney, Agent, or Firm*—Wolff & Samson PC

(57) ABSTRACT

The tobacco substitute composition according to the present invention is comprised of 80–90 weight percent of eucommia ulmoides, 1–10 weight percent of glycyrrhiza glabra, and 1–10 weight percent of periila frutescens. In the present invention, a flavoring material which is generally added to the composition of a tobacco such as a sodium chloride, glycerol, sweetener, spices, etc. may be added.

8 Claims, No Drawings

TOBACCO SUBSTITUTE COMPOSITION

BACKGROUND OF THE INVENTION

1. Field of the Invention

The present invention relates to a tobacco substitute composition, and in particular to a tobacco substitute composition which has an excellent effect to aid in smoking cessation. The composition does not include nicotine. The invention also relates to a method for preparing the composition.

2. Description of the Conventional Art

It is known in the art that a gum or a patch type product which contains a small amount of nicotine is used as a substitute for tobacco.

However, since these products contain nicotine, this is a disadvantage. Therefore, it is impossible to implement the desired effect of smoking cessation.

Tobacco substitutes which do not contain nicotine and are formed of the same type as the tobacco are described in U.S. Pat. Nos. 4,506,684 and 4,719,929 which use celluloses. In addition, in U.S. Pat. No. 4,813,438, a product made of bran, soybean, and mesquite is described. In the Japanese Patent Laid-open No. Pyung 1-273574, a product which is made of a coffee powder or leaves of a tea plant is described. In addition thereto, various products which use an organic compound as a substitute are known. In particular, in U.S. Pat. No. 4,600,025, 2-methyl-5-(pyrrolidinomethyl)thiazole and 2-methyl-5-(piperidinomethyl) thiazole are described.

However, since the above-described products have a flavor and taste different from tobacco, these products failed to attract a smoker's interest.

SUMMARY OF THE INVENTION

Accordingly, it is an object of the present invention to provide a tobacco substitute composition which has a taste very similar to the taste of tobacco, thereby making the composition suitable for use as a smoking cessation aid.

In order to achieve the above object, a tobacco substitute composition is provided which is formed of 80–90 weight percent of *Eucommia ulmoides*, 1–10 weight percent of *Glycyrrhiza glabra*, and 1–10 weight percent of *Perilla frutescens*.

In another example of the present invention, a flavoring material such as sodium chloride, glycerol, sweetener, spices, etc. which are generally added to tobacco may be used.

Additional advantages, objects and other features of the invention will be set forth in the description which follows and will become apparent to those having ordinary skill in the art upon examination of the following. The objects and advantages of the invention may be realized and attained as particularly pointed out in the appended claims as a result of the experiment compared to the conventional arts.

DETAILED DESCRIPTION OF THE INVENTION

As a result of experiments using various plants, we have found out that the leaves of *Eucommia ulmoides* have a taste which is similar to the taste of tobacco. *Eucommia ulmoides* is generally used as a therapy material for beriberi disease, hypertension, insomnia, lumbago, joint diseases, etc. In addition, *Eucommia ulmoides* is used as a nutrition material, and a stamina enhancing material. *Eucommia ulmoides* is characteristically non-toxic. The effective components of fully dried *Eucommia ulmoides* are as follows: 2.2 g of moisture, 12.3 g of protein, 7.0 g of paper, 10.1 g of fiber, 13.8 g of powder, 193 mg of phosphorus, 95.4 mg of Fe, 2.5 g of calcium, 3.99 mg of natrium, 330 mg of magnesium, 1.09 g of kalium, 17.8 ppm of zinc, 5.52 ppm of copper, 5.97 g of tannin, 205 mg of chlorophyll, 26.3 mg of tocopherol, 58 mg of vitamin C, and 480 mg of organic acid based on the total weight of 100 g.

If the *Eucommia ulmoides* exceeds the above-described amount, the taste of the composition is not soft with its small amount of *Glycyrrhiza glabra*. If the *Eucommia ulmoides* is used by an amount less than the above-described amount, it is impossible to obtain the taste of the tobacco.

Here, *Glycyrrhiza glabra* is added. *Glycyrrhiza glabra* serves to discharge sputum and smooth the airways. Therefore, *Glycyrrhiza glabra* overcomes the side effects which may occur due to the smoking. In the present invention, 1–10 weight percent of *Glycyrrhiza glabra* is used. *Glycyrrhiza glabra* has 40–50 times the sweetness of sugar.

In the present invention, about 1–10 weight percent of *Perilla frutescens* which has a curing effect for cough is added. Since *Perilla frutescens* has 200–300 times the sweetness of sugar, *Perilla frutescens* serves as a sweetener and an antiseptic.

In the composition according to the present invention, a flavoring material such as sodium chloride, glycerol, sweetener, spices, etc. may be added. As a sweetener, sugar, honey, an artificial sweetener, etc. may be added. In addition, peppermint oil may be added as a flavoring material.

The present invention will be illustrated by the following examples.

EXAMPLE 1

Preparation of Tobacco Substitute Composition 5 g of Glycyrrhiza glabra, 5 g of *Perilla frutescens*, and 3 g of glycerol were added to 90 g of *Eucommia ulmoides* leaves, and the resulting mixture was cut by 1 mm and then uniformly mixed. The tobacco substitute composition was formed in the same shape as the tobacco. An analysis of the components of the smoke of the product showed the amount of nicotine was 0 mg/cig, and the amount of tar was 14.4 mg/cig.

Example 2

Clinical Demonstration

This clinical demonstration was conducted by the Wonkwang University Hospital located in Mokpo, Korea. In this example, 27 smokers were selected and were asked to smoke the composition of example 1 for three weeks.

The results of the above-described clinical demonstration are shown in Table 1.

TABLE 1

| Degree | Number of patients | Ratio |
|---|---|---|
| *1. Recovered | 20 persons | 74.07% |
| 2. Good | 3 persons | 11.11% |
| 3. Moderate | 2 persons | 7.41% |

TABLE 1-continued

| Degree | Number of patients | Ratio |
|---|---|---|
| 4. Slight | 1 person | 3.70% |
| 5. Unchanged | 1 person | 3.70% |
| Sum | 27 persons | 99.99% |

*1. Recovered: Quit smoking.
2. Good: Smoking amount was decreased by more than 75%.
3. Moderate: Smoking amount was decreased by more than 50%.
4. Slight: Smoking amount was decreased by more than 25%.
5. Unchanged: No effect on smoking suppression.

The other symptoms of the demonstrators were as follows: No side effects: 13 persons, nausea: 5 persons, phlegm: 4 persons, dizziness: 2 persons, headache: 1 person, and a concentration decrease: 1 person. The above-described symptoms were known as smoking withdrawal effects, not side effects of the tobacco substitute of this invention.

Although the preferred examples of the present invention have been disclosed for illustrative purposes, those skilled in the art will appreciate that various modifications, additions and substitutions are possible, without departing from the scope and spirit of the invention as recited in the accompanying claims.

What is claimed is:

1. A tobacco substitute composition comprising 80–90 weight percent of *Eucommia ulmoides*, 1 –10 weight percent of *Glycyrrhiza glabra*, and 1–10 weight percent of *Perilla frutescens*.

2. The composition of claim 1, further comprising glycerol.

3. The composition of claim 1, further comprising peppermint oil.

4. A nicotine-free tobacco substitute composition comprising

80–90 weight percent of *Eucommia ulmoides;*

1–10 weight percent *Glycyrrhiza glabra*; and

1–10 weight percent of *Perilla frutescens.*

5. The composition of claim 4, comprising 87 weight percent *Eucommia ulmoides;*

5 weight percent *Glycyrrhiza glabra*; and 5 weight percent *Perilla frutescens.*

6. The composition of claim 4, further comprising a flavorant.

7. The composition of claim 6, wherein the flavorant is glycerol.

8. The composition of claim 6, wherein the flavorant is peppermint oil.

* * * * *